US009186683B2

(12) United States Patent
Hongo et al.

(10) Patent No.: US 9,186,683 B2
(45) Date of Patent: Nov. 17, 2015

(54) APPARATUS FOR COMMINUTING FIBROUS MATERIALS

(75) Inventors: Tadahiro Hongo, Tokyo (JP); Gary Verhoef, Pella, IA (US); Peilin Yang, Pella, IA (US); Scott Alan Rempe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 281 days.

(21) Appl. No.: 13/820,341

(22) PCT Filed: Sep. 2, 2010

(86) PCT No.: PCT/US2010/047705

§ 371 (c)(1),
(2), (4) Date: Mar. 1, 2013

(87) PCT Pub. No.: WO2012/030346

PCT Pub. Date: Mar. 8, 2012

(65) Prior Publication Data

US 2013/0161427 A1 Jun. 27, 2013

(51) Int. Cl.

| | |
|---|---|
| ***B02C 23/16*** | (2006.01) |
| ***B07B 1/46*** | (2006.01) |
| ***B02C 23/10*** | (2006.01) |
| ***B02C 13/06*** | (2006.01) |
| ***B02C 13/284*** | (2006.01) |
| ***D21B 1/06*** | (2006.01) |

(52) U.S. Cl.

CPC ..... *B02C 23/16* (2013.01); *B02C 13/06* (2013.01); *B02C 13/284* (2013.01); *B02C 23/10* (2013.01); *B07B 1/4609* (2013.01); *D21B 1/061* (2013.01); *B02C 2023/165* (2013.01)

(58) Field of Classification Search

CPC .... B02C 13/28; B02C 13/282; B02C 13/284; B02C 13/2804; B02C 23/16; B02C 23/10; B07B 1/4609

USPC ..... 241/89.3, 88.4, 73, 189.1

See application file for complete search history.

(56) References Cited

U.S. PATENT DOCUMENTS 763,639 A * 6/1904 Schoellhhorn et al. ..... 241/88.4
1,185,620 A * 6/1916 Blum ..... 241/73

(Continued)

FOREIGN PATENT DOCUMENTS

DE 10 2005 023 567 A1 11/2006
EP 1 990 399 A1 11/2008

(Continued)

OTHER PUBLICATIONS

International Search Report for corresponding International Patent Application No. PCT/US2010/047705 mailed May 27, 2011.

*Primary Examiner* — Mark Rosenbaum
(74) *Attorney, Agent, or Firm* — Merchant & Gould P.C.

(57) ABSTRACT

The present disclosure relates to a comminution apparatus including a rotational reducing unit that is rotatable about an axis of rotation. The rotational reducing unit includes a plurality of material reducing components that are mounted to a carrier. The material reducing components are rotated by the carrier in a first direction about the axis of rotation. The comminution apparatus also includes a screen at least partially surrounding the rotational reducing unit. The screen defines a plurality of sizing slots that have slot lengths and slot widths. The slots are elongated along the slot lengths such that the slot lengths are longer than the slot widths.

40 Claims, 17 Drawing Sheets

(56) References Cited

U.S. PATENT DOCUMENTS

| | | | | |
|---|---|---|---|---|
| 2,386,021 | A | | 10/1945 | Wetmore |
| 3,850,364 | A | * | 11/1974 | Robbins ..... 241/51 |
| 3,963,183 | A | | 6/1976 | Paulsen |
| 4,505,434 | A | | 3/1985 | Martenas et al. |
| 5,372,316 | A | | 12/1994 | Bateman |
| 5,413,286 | A | | 5/1995 | Bateman |
| 5,507,441 | A | | 4/1996 | De Boef et al. |
| 5,803,380 | A | | 9/1998 | Brand |
| 5,950,942 | A | | 9/1999 | Brand et al. |
| 6,059,210 | A | | 5/2000 | Smith |
| 6,227,469 | B1 | | 5/2001 | Daniels, Jr. et al. |
| 6,394,375 | B1 | | 5/2002 | Balvanz et al. |
| 6,412,715 | B1 | | 7/2002 | Brand et al. |
| 6,422,495 | B1 | | 7/2002 | De Boef et al. |
| 6,517,020 | B1 | | 2/2003 | Smith |
| 6,622,951 | B1 | | 9/2003 | Recker et al. |
| 6,840,471 | B2 | | 1/2005 | Roozeboom et al. |
| 6,843,435 | B2 | | 1/2005 | Verhoef et al. |
| 6,845,931 | B1 | | 1/2005 | Smith |
| 7,077,345 | B2 | | 7/2006 | Byram et al. |
| 7,204,442 | B2 | | 4/2007 | Roozeboom et al. |
| 7,213,779 | B2 | | 5/2007 | Roozeboom et al. |
| 7,461,802 | B2 | | 12/2008 | Smidt et al. |
| 7,959,097 | B2 | | 6/2011 | De Boef |
| 7,971,818 | B2 | | 7/2011 | Smidt et al. |
| 8,104,701 | B2 | | 1/2012 | Smidt et al. |
| 8,245,961 | B2 | | 8/2012 | Vroom et al. |
| 2003/0085310 | A1 | | 5/2003 | Galanty et al. |
| 2004/0159725 | A1 | | 8/2004 | Irwin |
| 2004/0251346 | A1 | | 12/2004 | Verhoef et al. |
| 2005/0001083 | A1 | | 1/2005 | Cook et al. |
| 2005/0098671 | A1 | | 5/2005 | Verhoef et al. |
| 2005/0121550 | A1 | | 6/2005 | Smith |
| 2006/0043226 | A1 | | 3/2006 | Roozeboom et al. |
| 2010/0068121 | A1 | | 3/2010 | Park et al. |

FOREIGN PATENT DOCUMENTS

| | | | |
|---|---|---|---|
| JP | 2000-354785 | A | 12/2000 |
| JP | 2006-122894 | A | 5/2006 |
| WO | WO 03/066296 | A1 | 8/2003 |

* cited by examiner

APPARATUS FOR COMMINUTING FIBROUS MATERIALS

This application is a National Stage Application of PCT/2010/047705, filed on 2 Sep. 2010 and which application is incorporated herein by reference. To the extent appropriate, a claim of priority is made to each of the above disclosed applications.

TECHNICAL FIELD

The principles disclosed relate to an apparatus for comminuting fibrous materials, particularly useful for processing of fibrous materials such as empty fruit bunches (EFB).

BACKGROUND

Empty Fruit Bunches are the by-product of processing the fruit or nut of palm trees for the production of palm oil. The characteristics of EFB are known to substantially consist of fibers. Processing technologies and systems for this material have been, and continue to be developed. An example is the process described in patent application US20100068121 including the step of pulverizing the material into 0.5-5 centimeter2 in average surface area or 0.1 to 5 centimeter in average length. EP1990399, another example of a processing method, includes an example of a process that includes the step of shredding, to obtain the EFB fibers as half fabricate. Due to the unique characteristics of this material, the significant fibrous content, the comminution process is difficult. Slow speed shredders are currently used, but the cost and productivity of these machines has resulted in significant cost and processing complexity. There is a need for a device capable of improved processing specifically for comminution of EFB materials. This need is evident by the fact that several patent applications have recently been published, disclosing mechanisms that were developed to process this material or type of material including WO03066296, JP2006122894, JP2000354785, DE102005023567.

SUMMARY

The present disclosure relates to a comminution apparatus suitable for processing fibrous material such as EFB. This same apparatus will have advantages processing other fibrous materials as well as EFB including but not limited to palm tree branches, fronds, and various other crops such as bast fiber plants like kenaff, hemp, and flax.

DETAILED DESCRIPTION

Figure 1:
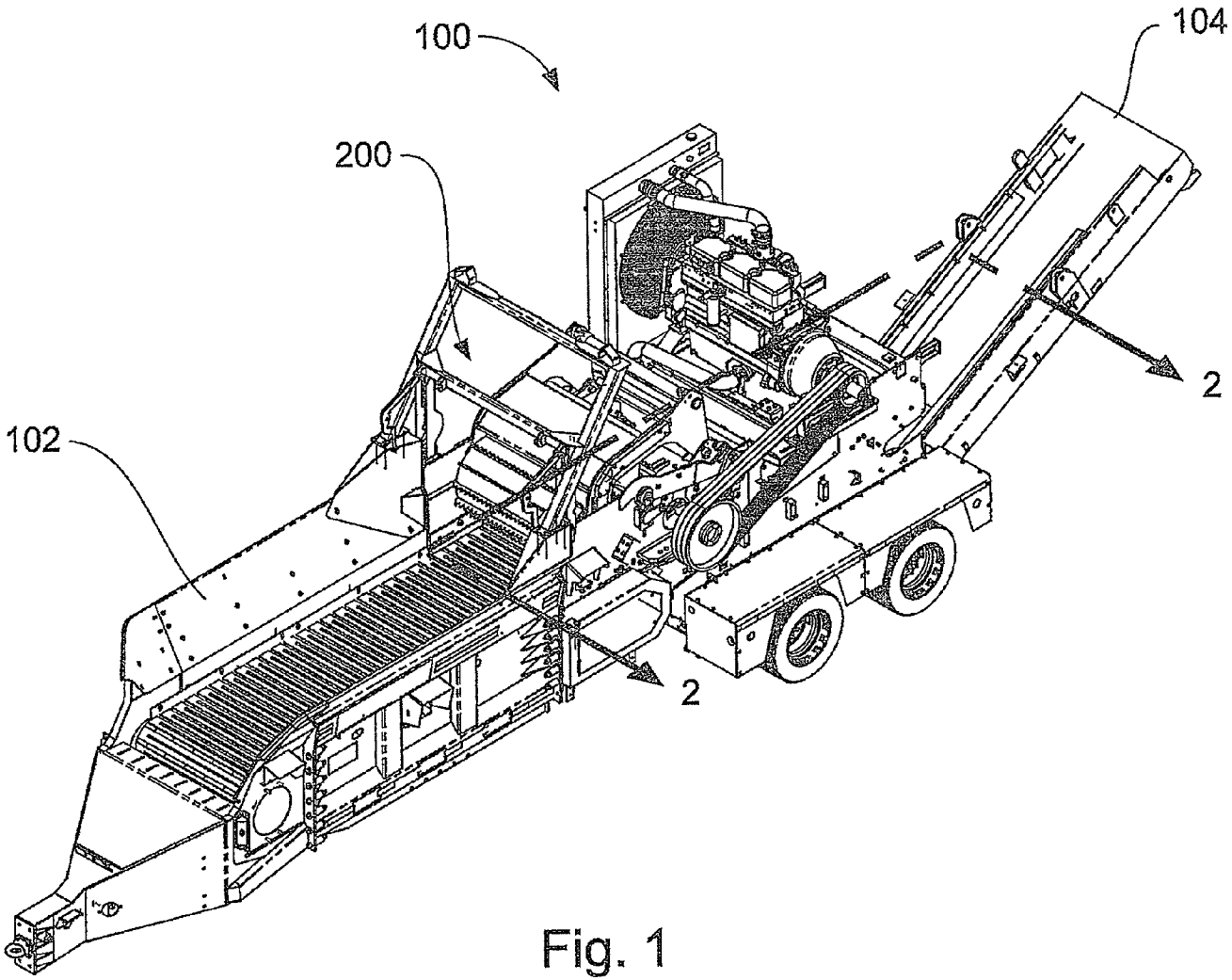
FIG. 1 is an isometric of an embodiment of an overall comminution machine in accordance with the principles of the present disclosure.

With reference now to the various figures in which identical components are numbered identically throughout, a description of various exemplary aspects of the present disclosure will now be provided. The disclosed embodiments are shown in the drawings and described with the understanding that the present disclosure is to be considered an exemplification of certain inventive aspects and is not intended to limit the inventive aspects to the embodiments disclosed.

Various machines have been developed for comminuting materials. Examples, with common names, include: shredders, having a relatively slow speed comminuting apparatus typically used for ripping and breaking hard, tough materials apart into relative coarse particles; chippers having a relatively high speed comminuting apparatus, either a rotating disc or a rotating drum, with sharp material reducing components typically used for cutting wood materials into small chips; and grinders having a relatively high speed comminuting apparatus, a rotating drum typically with robust and blunt material reducing components, that is located adjacent a sizing screen that is used to tear and shatter materials into a variety of particle sizes.

Each of these machines has an infeed section, a comminution section, and a discharge section. Various combinations of these various components have been developed to process certain types of materials. The current disclosure is applicable to grinders (e.g., tub grinders and horizontal grinders), shredders and chippers, but the comminution technology disclosed herein is not limited to those configurations. The basic comminution section of the current disclosure has been developed to process a unique material, and could be adapted to a variety of different infeed and discharge systems.

Figure 2:
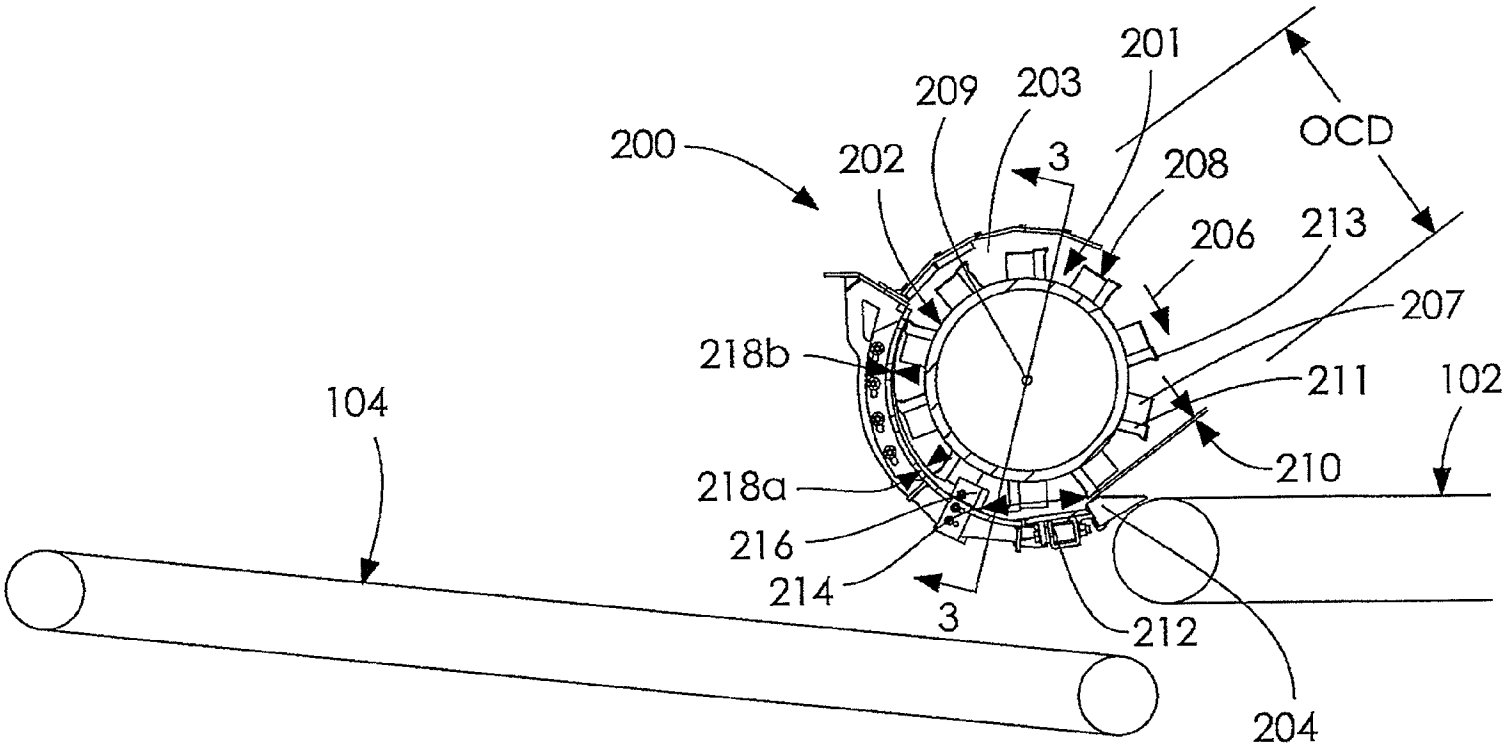
FIG. 2 is a schematic representation of the basic components of the comminution machine of FIG. 1 as taken from section line 2-2 as shown in FIG. 1.

FIG. 1 is a preferred embodiment of a complete machine, a horizontal grinder 100 with an infeed system 102 (e.g., a conveyor), a discharge system 104 (e.g., a conveyor) and a comminution apparatus 200. As shown at FIG. 2, the comminution apparatus 200 includes a rotational reducing unit 201 mounted within a comminution chamber 203. The present disclosure describes aspects of a comminution apparatus that can be used in combination with other types of infeed devices and/or discharge devices. For example, comminution apparatuses in accordance with the present disclosure can be used with tub grinder type infeed systems having top-load tubs with rotating sidewalls that help feed material toward comminution apparatuses mounted at floors of the tubs. An example tub grinder infeed system is disclosed at U.S. Pat. No. 5,950,942, which is incorporated by reference herein in its entirety.

The rotational reducing unit 201 illustrated in FIG. 2 includes a material reducing component carrier depicted as a drum 202 that is rotationally driven about an axis of rotation 209 by a drive mechanism. One example of this style of drum is described in more detail in U.S. Pat. No. 7,204,442 herein incorporated by reference. Other styles of reducing component carriers are disclosed at U.S. Pat. Nos. 5,507,441; 7,213,779; and 6,840,471 that are hereby incorporated by reference. The drum 202 is located adjacent the infeed system 102. An anvil 204 is located at the end of the infeed system 102. One example of a suitable anvil is described in more detail in U.S. Pat. No. 7,461,802 herein incorporated by reference. The anvil 204 is located such that rotation of the drum 202 in a reducing direction 206 about the axis 209 will move the material from the infeed system 102 into contact with the anvil 204. Some machine configurations use an opposite direction of rotation of the drum, such that the material is lifted up, in a machine known as an up-cut machine, rather than down as in this depicted embodiment. Aspects of the present disclosure would work in an up-cut machine, but for the sake of clarity, this disclosure will focus only on the illustrated embodiment.

The drum 202 can carry any number of material reducing components (e.g., edges, grinding members, cutters, plates, blocks, blades, bits, teeth, hammers, shredders or combinations thereof) 208 supported in any preferred method. In certain embodiments, the material reducing components can have a blunt configuration having a blunt impact region. The blunt impact region can be rounded so as to be less prone to rapid wear and so as to provide more of a grinding action as compared to a chipping action. However, in other embodiments, material reducing components with sharp edges/blades or points suitable for chipping or cutting can be used. In one embodiment, when the drum 202 is rotated the material reducing components 208 are swept along an outer cutting diameter OCD of approximately 36 inches (914 mm) and the drum is rotated at an operating speed of approximately 1000 rpm, which results in a material reducing component tip speed of approx 9800 ft/min (2987 m/min). The various aspects of the present disclosure are not dependent on this exact arrangement, and carriers of different diameters operating at different speeds could be utilized. In certain embodiments, it is preferred to have a minimum tip speed of the material reducing components of at least 5000 ft/min (1500 m/min).

Referring to FIG. 2, the drum 202 is shown carrying reducing components 208 in the form of a plurality of reducing hammers 207 that project radially outwardly from the drum 202. Leading faces of the hammers 207 are covered and protected by reducing blocks 211 that are fastened to the hammers 207. The reducing blocks 211 have outermost reducing edges 213 oriented to extend primarily along the axis of rotation 209 of the reducing unit 201. In certain embodiments, the outermost edges 213 can be rounded or otherwise blunt. When the reducing unit 201 is rotated about the axis 209, the outermost edges 213 move along the outer cutting diameter (OCD) of the reducing unit 201.

The anvil 204 is preferably positioned within a specific distance of the outer cutting diameter of the material reducing components 208, with a gap 210 of between 0.2 inches and 0.5 inches. Depending upon the system and the type of material being processed, the size of the gap 210 can be varied, and may be adjustable in certain embodiments. The anvil 204 defines the end of the infeed. EFB or any material being comminuted, generally referred to herein generically as material, is propelled by the material reducing components 208 rotated by drum 202, to pass-by the anvil 204. The material travels either in front of the material reducing components 208 or between the material reducing components and the anvil, through the gap 210. As the material continues to travel with the drum, centrifugal force will cause the material to move, away from the axis of rotation 209 of the drum 202, and into contact with a transition plate 212. In the depicted embodiment, the plate 212 is a solid plate that forces the material to remain engaged with the material reducing components 208.

Figure 3:
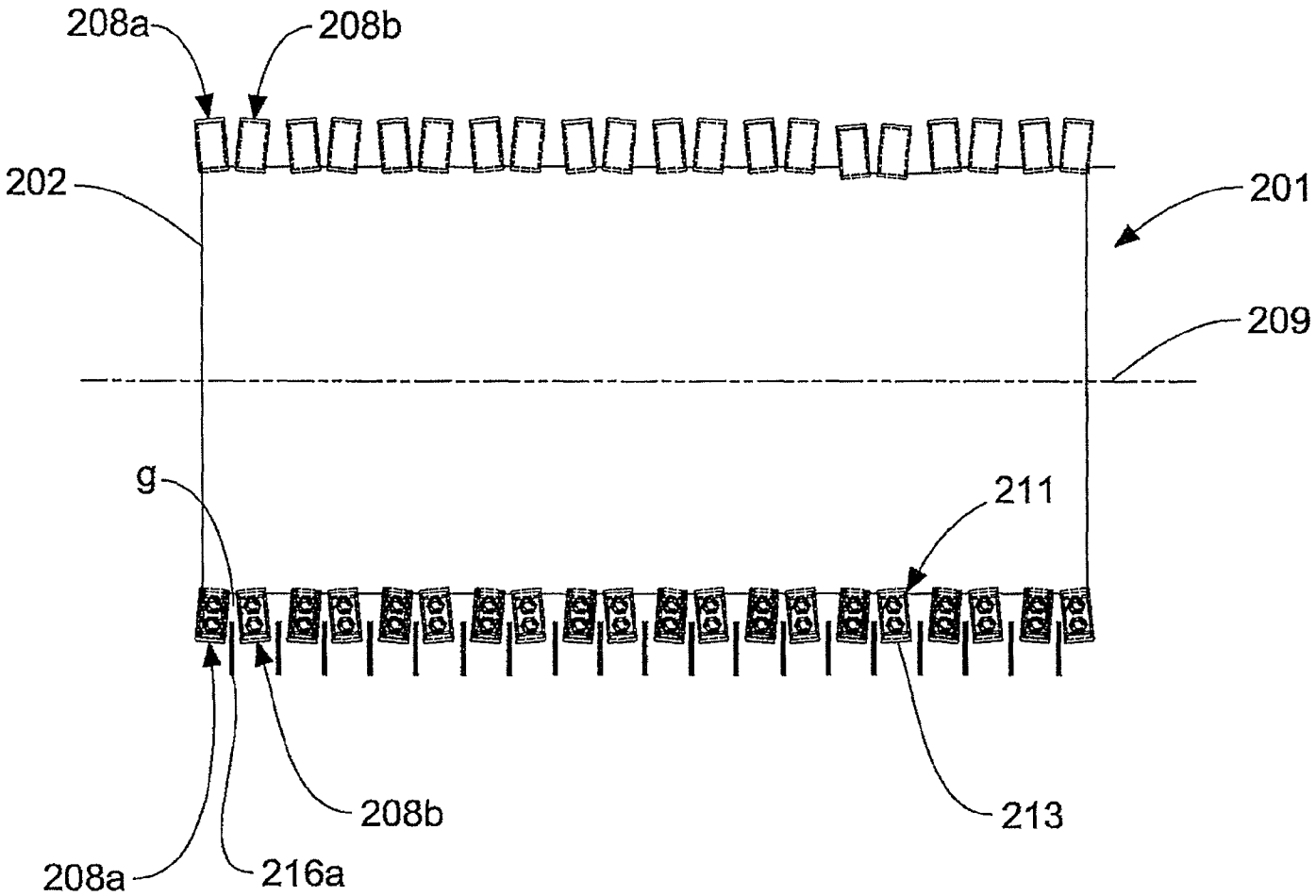
FIG. 3 is a schematic representation of the basic components of the comminution machine of FIG. 1 as taken from section line 3-3 as shown in FIG. 2.

As the material continues to travel with the material reducing components 208, it is forced into engagement with fixed knives 216 that during use are stationary relative to the anvil and the transition plate, fixed to the main frame and positioned in an overlapping arrangement with the material reducing components 208, as illustrated in FIG. 3. This figure is a schematic representation of the drum 202, showing all the material reducing components, this embodiment having 20 material reducing components, as they would appear at two positions during a single rotation of the drum, each material reducing component in a lower position, and in an upper position. For instance, material reducing component **208*a*** (the material reducing component on the left side of the drum)

is shown in top and bottom labeled positions. Likewise the next adjacent material reducing component 208*b* is also labeled. This figure shows that there is a gap g between adjacent material reducing components that allows the fixed knife 216*a* to project into an overlapping arrangement with material reducing components 208*a* and 208*b*. The overlap provided between the fixed knives and the outer cutting diameter OCD of the material reducing components allows the machine to effectively engage and act on a large percentage of the material. In one embodiment, the overlap may be at least 0.75 inches (19 mm). As shown at FIG. 3, a fixed knife is positioned in each gap g between material reducing components, this preferred embodiment having 19 fixed knives in combination with the 20 material reducing components. Of course, in other embodiments, other numbers of material reducing components and knives can be used.

The setback position of the fixed knives, relative to the anvil, has been found to affect performance. This relationship is defined as distance 214, the fixed knife setback, shown on FIG. 2. One embodiment may have a setback of approximately 6 inches. Another embodiment may have a setback in a range between 4 and 8 inches. Still other embodiments may have setbacks of at least 4 inches.

Figure 4:
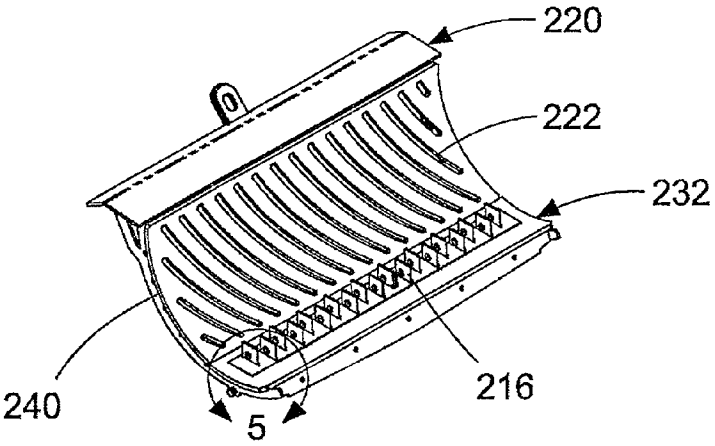
FIG. 4 is a perspective view of a sizing unit adapted to be removably mounted around a comminution chamber of the comminution machine of FIG. 1, the sizing unit includes a screen frame, a screen supported on the screen frame and knives supported on the screen frame.
Figures 8, 9, 10:
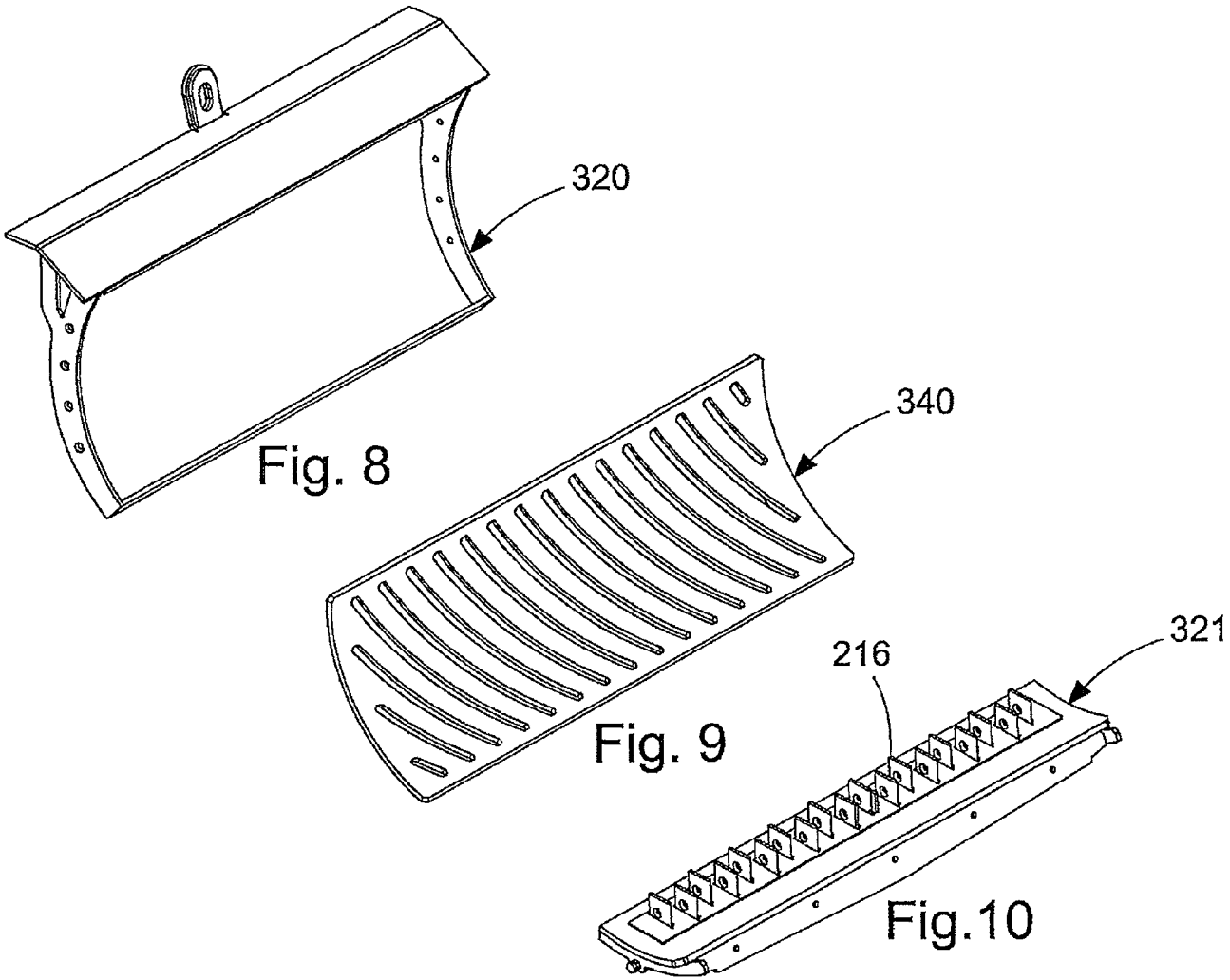
FIG. 8 is a perspective view of another screen frame in accordance with the principles of the present disclosure.
FIG. 9 is a perspective view of a screen plate adapted to be removably mounted on the screen frame of FIG. 8.
FIG. 10 is a perspective view of a knife structure adapted to be mounted upstream within a comminution machine from the screen frame of FIG. 8.

The fixed knives can be subjected to a significant amount of wear as the material is forced past by the material reducing components, and thus will preferably be made from a material that is resistant to abrasion. The method of supporting these fixed knives can provide for a method of easily servicing them. FIG. 4 illustrates one embodiment that has the fixed knives positioned onto a screen frame 220 that is removable from the grinder 100. A screen frame that is removable in the same way is described in more detail in U.S. Pat. No. 6,843,435 that is herein incorporated by reference. The embodiment of the screen frame 220 of the present disclosure includes unique features including the fixed knives 216. An alternative design is illustrated in FIG. 10 wherein a fixed knife frame 321 can be separated from a shortened screen frame 320 (see FIG. 8), and is configured to be mounted to the frame of the machine 100 adjacent the shortened screen frame 320. This configuration would allow the screen and screen frame 320 to be removed, while the fixed knives are left in the machine. A screen plate 340 (see FIG. 9) can be removed from the screen frame 320 for replacement, repair or to reverse the screen plate. This may be advantageous if the screens need to be maintained more frequently than the fixed knives. This would also be advantageous because the fixed knives are preferably located accurately due to their overlapping relationship with the rotating material reducing components.

Figure 5:
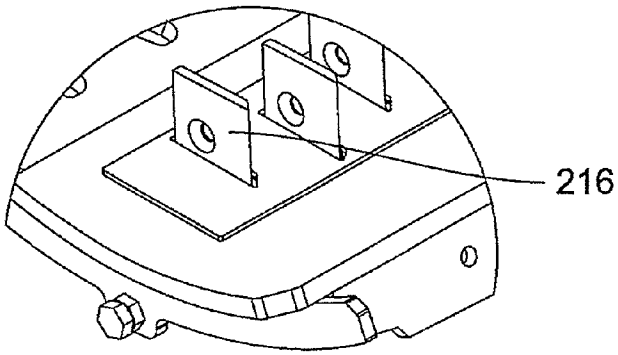
FIG. 5 is an enlarged view of a portion of the sizing unit of FIG. 4.

The fixed knives 216 can be a variety of shapes, ranging from sharpened knives with a sharp edge on the front side, the side that first contacts the material, to simple blunt knives made from bar stock. One embodiment of the fixed knives 216 is illustrated in FIG. 5 with a sharpened edge. The knife that is shown in this embodiment is also used as a brush chipper knife, with 3 mounting holes. One of the holes is shown exposed, while the other two are used to attach the knife to the frame. A variety of knife designs and mounting methods are possible.

After the material has passed by the fixed knives 216, it is forced through a series of sizing slots 222 defined by a screen plate 240, shown in FIG. 4 attached to the screen frame 220 along with the fixed knives 216. The fixed knives 216 are part of a fixed knife unit/structure 232 secured to the screen frame 220. In certain embodiments, as illustrated in FIG. 7, the screen plate 240 can be removed from sizing screen supports 234 of the screen frame 220. This configuration would allow a screen plate 240, shown in FIG. 6, to be removable, and would allow maintenance of the screen plate 240, including reversal or replacement, while allowing reuse of the screen frame 220. The screen frame 220 along with the screen plate 240 and the knives 216 together can form a sizing unit that is removable from the grinder 100 as a unit.

Figure 6:
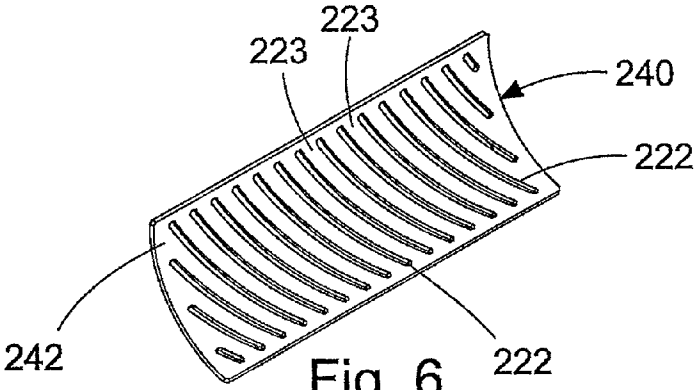
FIG. 6 is a perspective view of a screen plate of the sizing unit of FIG. 4.
Figure 7:
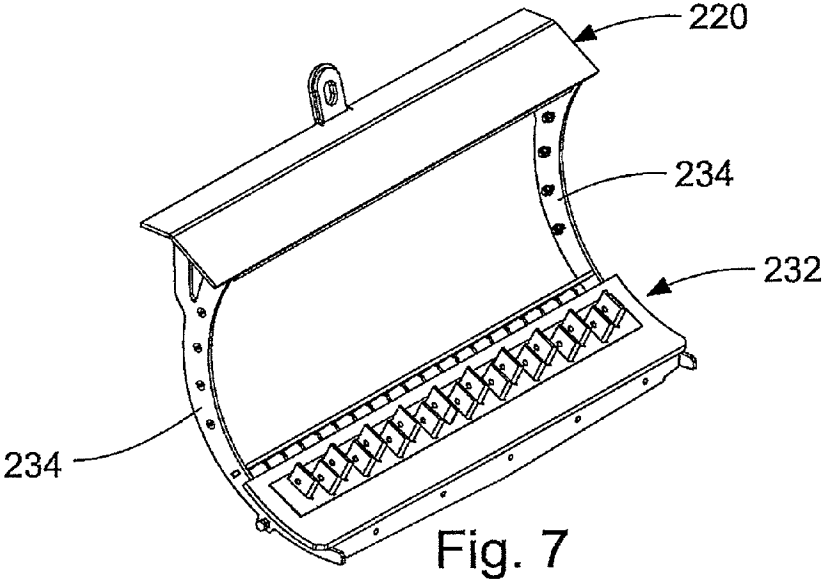
FIG. 7 is a perspective view of the sizing unit of FIG. 4 with the screen plate removed from the screen frame.

The screen plate 240 illustrated in FIG. 6 includes sizing slots 222 of the present invention, of long relatively narrow construction, with a sizeable land area 223 between each slot 222. The screen plate 240 is arcuate, such that an inside surface 242 is concave and adjacent the outer tip reducing/cutting diameter defined by the material reducing components 208 when mounted to the drum 202. The clearance between this inside surface 242 and the outer cutting diameter OCD of the material reducing component is labeled in FIG. 2 as screen plate clearance 218*a* at the leading edge and 218*b* at the trailing edge. The clearances 218*a* and 218*b* can be the same or different. In the depicted embodiment, the clearance 218*b* is less than the clearance 218*a*.

Screen plate clearance has an affect on the productivity of the comminution apparatus, and can be made adjustable. The preferred embodiment includes a mechanism (e.g., a cam, slide, or other structure) to adjust the clearance 218*b*. The exact details of the mechanism can be different from machine to machine. However, it has been found that for the processing of fibrous materials like EFB the ability to adjust this clearance may provide the capability to more specifically adjust the size of the processed material. It has been found that reducing clearance 218*b* tends to increase the particle size and also rate of production. Increasing this clearance tends to result in reduced particle size and reduced rate of production. The shape of the slots in the screen plate also can affect performance.

Figure 11:
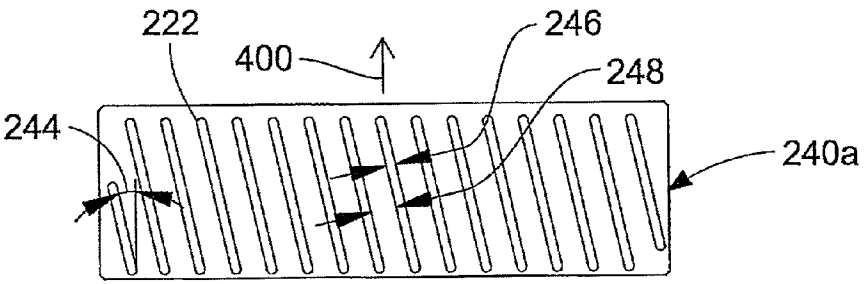
FIG. 11 shows a flat plan view of another screen plate in accordance with the principle of the present disclosure.
Figure 12:
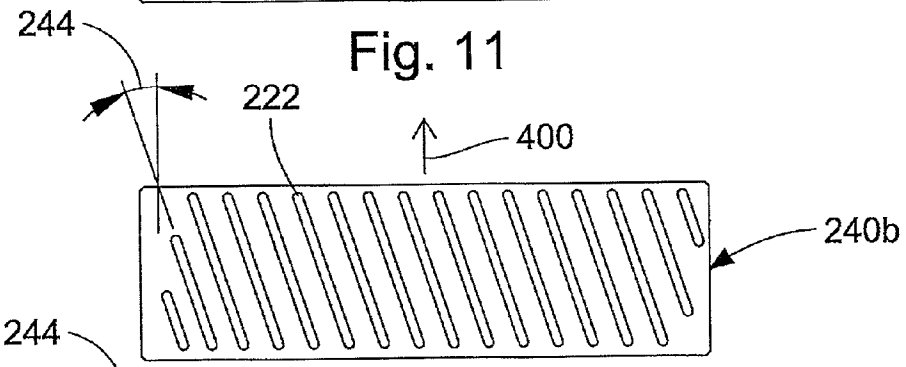
FIG. 12 shows a flat plan view of a further screen plate in accordance with the principle of the present disclosure.
Figure 13:
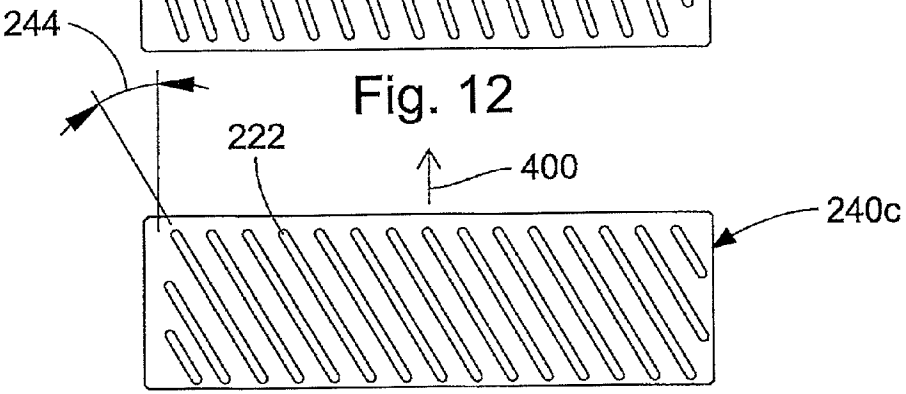
FIG. 13 shows a flat plan view of a further screen plate in accordance with the principle of the present disclosure.

Screen plate 240 is manufactured, in its final form as an arcuate plate. The apertures or slots 222 can be cut into the plate in a number of ways, including cutting the slots after the plate is rolled into its final form, or cutting the slots while the plate is flat, and then forming it into the final arcuate shape. For the sake of clarity, FIGS. 11-13 are illustrations of screen plates 240*a*-240*c* in their flat form, to illustrate various embodiments of the sizing slots. FIG. 11 illustrates a first embodiment wherein slots 222 are obliquely angled relative to the direction of travel 400 of the material reducing components, at an angle 244 of twelve degrees. The width 246 of the slots has been found to impact the performance, with a preferred range between 0.75 inches (19 mm) to 2.0 inches (50 mm), the screen plate 240*a* depicted in FIG. 11 having slots 222 with the width 246 equal to approx one inch (25 mm). This range of slot width has shown to be effective for EFB materials. A different range may be appropriate for other types of material. In an example embodiment, the slots can have a length to width ratio of at least 10 to 1, or at least 20 to 1, or at least 30 to 1.

The land area 223, the space between the slots, has been found to affect performance as well. The screen plate depicted in FIG. 11 has a land width 248 of approximately 2.7 inches (69 mm). The land width is preferably at least 1.5 inches (38 mm), or within a range of 1.5 inches (38 mm) to 3 inches (75 mm).

FIG. 12 depicts a screen plate 240*b* with the same slot width, and the same land width as the screen of FIG. 11, but with the angle 244 modified to 18 degrees, and FIG. 13 illustrates a screen plate 240*c* with the angle 244 of 30 degrees. In certain embodiments, the angle of the slots, angle 244, can be between 10 and 45 degrees, preferably between 12 and 30 degrees. In certain embodiments, the angle 244 is at least 10 degrees. The more angled the slots are, the more aggressive the screen becomes, and the more size reduction is achieved. Thus, the screen plate depicted in FIG. 13 is expected to produce material that is finer than the screen plate depicted in FIG. 11. The rate of production is expected to also vary, with the screen plate of FIG. 13 being expected to be lower than the rate of production with the screen plate of FIG. 11.

Figure 14:
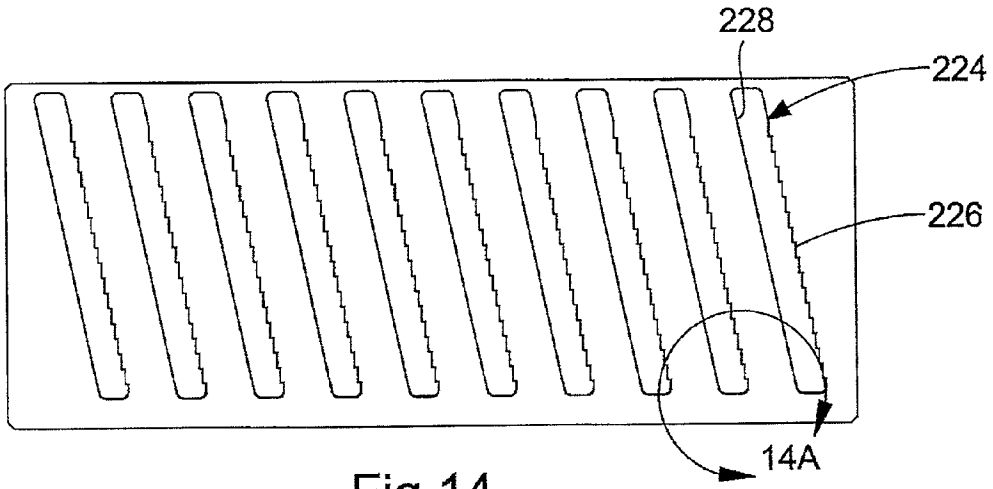
FIG. 14 shows a flat plan view of a further screen plate in accordance with the principle of the present disclosure.
Figure 14A:
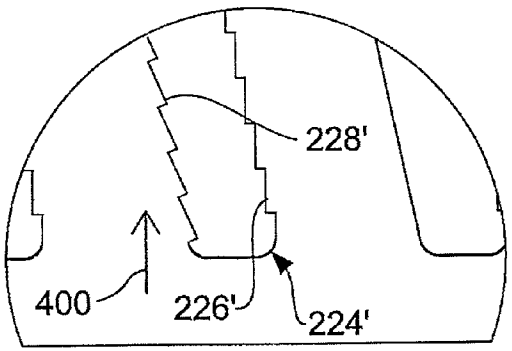
FIG. 14A is an enlarged view of a portion of the screen plate of FIG. 14.

The shape of the slots in the screen plate can be configured to provide shapes that may increase the efficacy of comminution. As an example FIG. 14 illustrates sizing slots 224 with a first side 226 that has a non-continuous surface (e.g., a broken surface, a segmented surface, an interrupted surface, a surface having discrete structures) with a shape consisting of notches (i.e., teeth, serrations, projections, etc.), and a second side 228, with a continuous surface. FIG. 14A shows sizing slots 224' with first and second sides 226', 228' both having irregular surfaces. A screen plate made to be removed and reversible, as shown in FIG. 6, combined with the slot configuration disclosed in FIG. 14A, allows for improved utilization due to the ability to utilize both sides. With a material flow direction 400, with the screen plate installed in the illustrated orientation, side 226' will be the primary comminution surface. That side will experience higher rate of wear than the opposite side. When the wear affects performance, the screen plate can be removed and reversed, so that the opposite side, 228', would be the primary comminution surface.

In one example embodiment, all of the previously described features can work together to form a complete comminution system including:

1) a drum with blunt material reducing components rotating at a high velocity, with material reducing components arranged to provide open spaces between adjacent material reducing components;
2) an anvil adjacent the drum that acts to meter the material as the material reducing components engage that material, an initial comminution action occurs as the material reducing components impact and propel the material past the anvil and around the drum;
3) a space after the anvil to allow the material to move towards the outer tip diameter of the material reducing components;
4) a set of fixed knives in overlapping relationship with the material reducing components, extending from the beyond the material reducing component tip diameter, and to a diameter less than the material reducing component tip diameter to overlap at least by 0.75 inches, creating a second comminution action; and
5) a sizing screen with long narrow slots with a primary comminution surface defined by an angled orientation of the slots of between 10 degrees and 45 degrees, creating a third comminution action.

Figure 15:
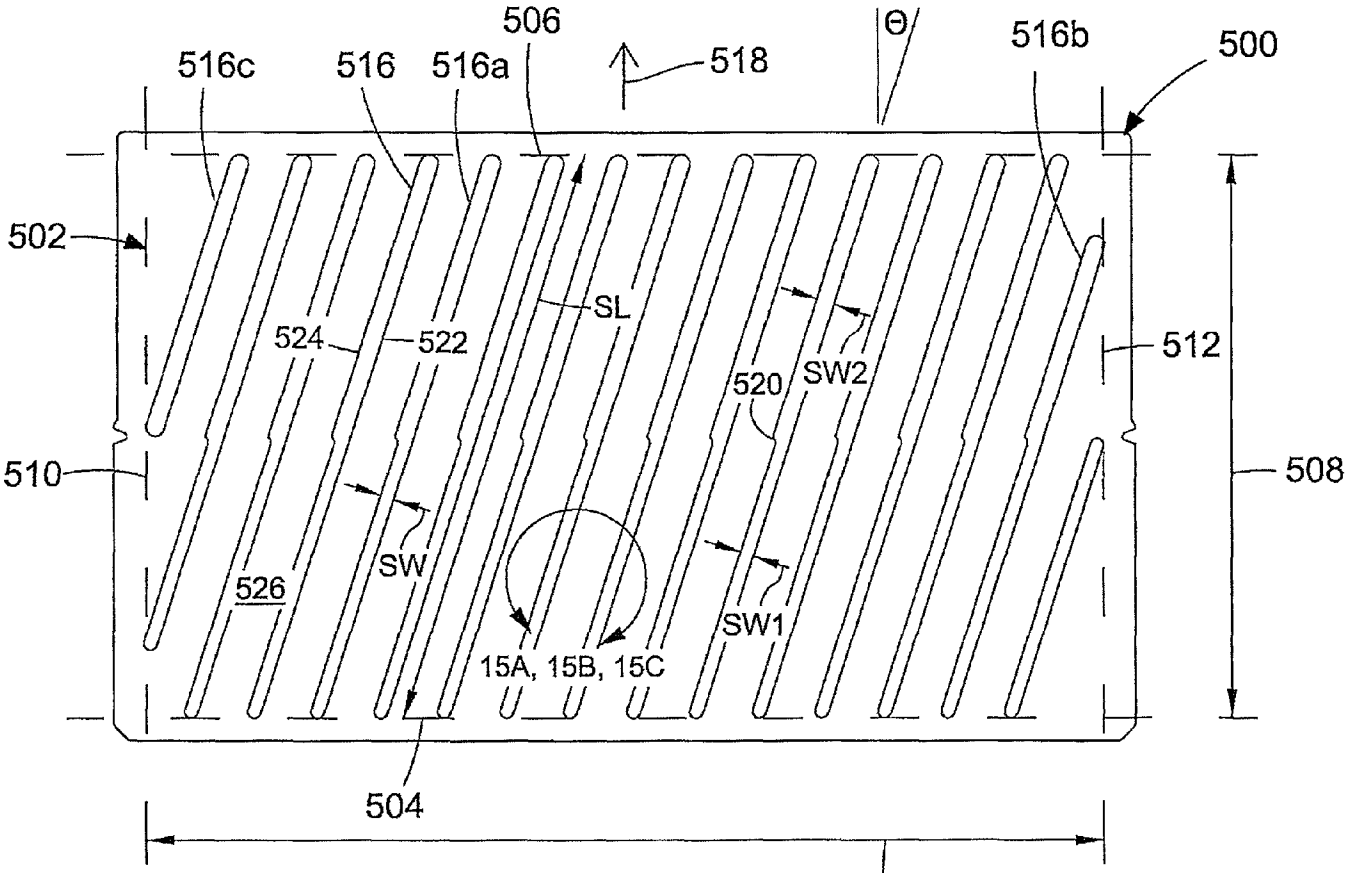
FIG. 15 shows a flat plan view of a further screen plate in accordance with the principle of the present disclosure.
Figure 15A:
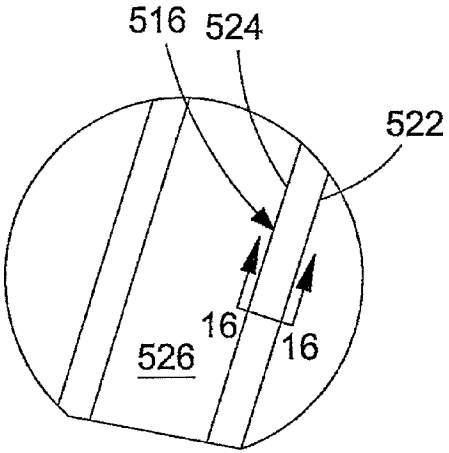
FIG. 15A is an enlarged view of a portion of the screen of FIG. 15.
Figure 15B:
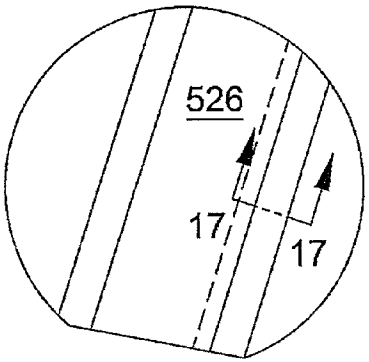
FIG. 15B is an enlarged view of a portion of the screen of FIG. 15 showing a first alternative slot shape.
Figure 15C:
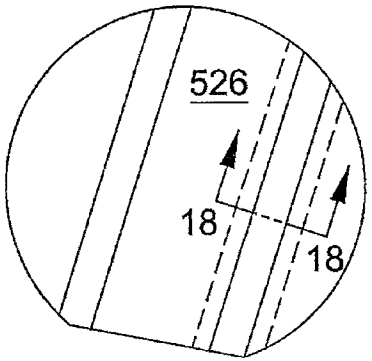
FIG. 15C is an enlarged view of a portion of the screen of FIG. 15 showing a second alternative slot shape.
Figure 16:
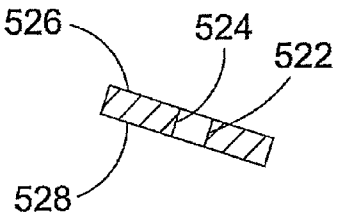
FIG. 16 is a cross-sectional view taken along section-line 16-16 of FIG. 15A, the view shows a straight-sided slot shape.

FIGS. 15 and 16 depict another screen 500 in accordance with the principles of the present disclosure. The screen 500 is adapted to at least partially to circumferentially surround a rotational reducing unit of a comminution apparatus. The screen 500 includes a screening region 502 having an upstream-most boundary 504 separated from a downstream-most boundary 506 by an upstream-to-downstream screen dimension 508. When the screen 500 is mounted within a comminution apparatus, the upstream-to-downstream dimension is parallel to a direction of travel 518 of material reducing components of the comminution apparatus. The screening region 502 also has a first side boundary 510 (e.g., left side boundary) separated from a second side boundary 512 (e.g., a right side boundary) by a cross-screen dimension 514. The cross-screen dimension 514 is transversely oriented relative to the upstream-to-downstream screen dimension 508.

The screening region 502 includes a plurality of sizing slots 516 circumscribed by the boundaries 504, 506, 510 and 512 of the screening region 502. The sizing slots 516 have slot lengths SL and slot widths SW. The sizing slots 516 are elongated along the slot lengths SL such that the slot lengths SL are longer than the slot widths SW. The slot lengths SL of the sizing slots 516 are shown extending primarily along the upstream-to-downstream screen dimension 508 between the upstream-most boundary 504 and the downstream-most boundary 506. The slot widths SW are shown extending primarily along the cross-screen dimension 514 between the first side boundary 510 and the second side boundary 512. The sizing slots 516 are spaced-apart from one another (e.g., by lands) along the cross dimension 514. The sizing slots 516 are arranged inside the boundaries 504, 506, 510, 512 in a single row of parallel sizing slots that are spaced-apart from one another along the cross-screen dimension 514. The sizing slots 516 are continuously open (i.e., open without interruption) along their slot lengths.

The continuously open slot lengths of the sizing slots 516 preferably traverse a significant portion of the total length of the upstream-to-downstream screen dimension 508. The extended open construction of the sizing slots 516, which extends primarily in the upstream-to-downstream direction, assists in reducing the likelihood of plugging. Certain of the slots in accordance with the principles of the present disclosure have continuously open slot lengths that traverse more than 50 percent of the upstream-to-downstream screen dimension 508. Other slots in accordance with the principles of the present disclosure have continuously open slot lengths that traverse at least 75 percent of the upstream-to-downstream screen dimension 508. Still other slots in accordance with the principles of the present disclosure have continuously open slot lengths that traverse at least 90 percent of the upstream-to-downstream screen dimension 508. Further slots in accordance with the principles of the present disclosure have continuously open slot lengths that traverse the entire length of the upstream-to-downstream screen dimension 508 (i.e., 100 percent of the upstream-to-downstream screen dimension 508).

Referring to FIG. 15, slots of various lengths are shown. For example, slots 516*a* have continuously open slot lengths that traverse the full length of the upstream-to-downstream screen dimension 508. Thus, upstream ends of the slots 516*a* define the upstream-most boundary 504 of the screening region 502 and downstream ends of the slots 516*a* define the downstream-most boundary 506 of the screening region 502. Slots 516*b* have continuously open slot lengths that traverse 50 to 90 percent of the upstream-to-downstream screen dimension 508. Slots 516*c* have continuously open lengths that traverse less than fifty percent of the upstream-to-downstream screen dimension 508. The slots 516*a*, 516*b* and 516*c* are shown parallel to each other end and are shown extending primarily along the upstream-to-downstream screen dimension 508.

As described above, the screen 500 is preferably used in combination with a rotational reducing unit including a plurality of material reducing components mounted to a reducing component carrier. The material reducing components are rotated by the carrier about a central axis of the carrier such the material reducing components define a cutting path (e.g., a cutting outer diameter) surrounding the axis of rotation. As used herein, the reducing component travel direction 518 is the direction, viewed in plan view (as shown at FIG. 15), in which the reducing components move as the carrier carries the material reducing components along the cutting path from the upstream-most boundary 504 to the downstream-most boundary 506 of the screening region 502. The slot lengths SL of the sizing slots 516 are orientated at oblique angles θ relative to the reducing component travel direction 518. As shown at FIG. 15, the oblique angles θ are determined/measured from the plan view of the screen. In certain embodiments, the oblique angles θ are less than 45 degrees. In other embodiments, the oblique angles θ are in the range of 5-30 degrees. In still other embodiments, the oblique angles θ are in the range of 10-25 degrees. Similar to earlier disclosed embodiments, the slots can have a length to width ratio of at least 10 to 1, or at least 20 to 1, or at least 30 to 1.

It will be appreciated that the desired size of the angle θ is dependent upon the material being processed and the desired characteristics (e.g., size, flow characteristic, etc.) of the reduced material exiting the screen. For fibrous materials such as empty fruit bunches, it is generally preferred for the slots 516 to be obliquely angled relative to the reducing component travel direction 518. However, in other embodiments, the continuously open lengths of the sizing slots may be parallel to the reducing component travel direction 518.

Referring still to FIG. 15, the slot widths SW of the sizing slots 516 include first widths SW1 adjacent to the upstream-most boundary 504 and seconds widths SW2 adjacent the downstream-most boundary 506. The first widths SW1 are depicted as being smaller than the second widths SW2. Steps 520 at intermediate locations along the lengths of the slots 516 provide transitions in slot width from the first slot width SW1 to the second slot widths SW2.

Figure 17:
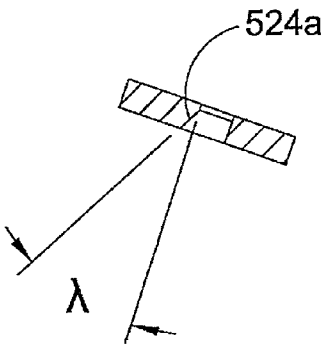
FIG. 17 is a cross-sectional view taken along section-line 17-17 of FIG. 15B, the view shows a slot with one straight-side and one tapered side.
Figure 18:
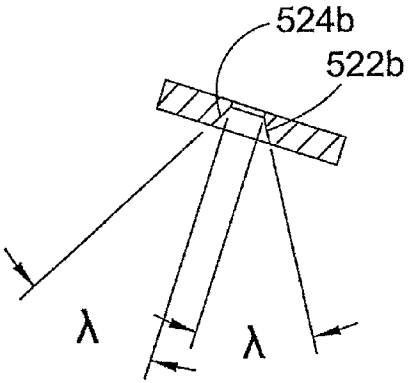
FIG. 18 is a cross-sectional view taken along section-line 18-18 of FIG. 15C, the view shows a slot with two tapered sides.

The sizing slots 516 have upstream slot-defining surfaces 522 that are opposed by downstream slot-defining surfaces 524. The upstream and downstream slot-defining surfaces 522, 524 are parallel to the slot lengths. As shown at FIG. 16, the slot-defining surfaces 522, 524 extend through the screen 500 from an inside surface 526 of the screen 500 to an outside surface 528 of the screen 500. The inside surface 526 of the screen 500 preferably faces toward the rotational reducing unit and circumferentially surrounds at least a portion of the rotational reducing unit. As shown at FIG. 16, the slot-defining surfaces 522, 524 are depicted as being parallel to one another. However, in other embodiments, slot-defining surfaces in accordance with the principles of the present disclosure can be angled at relief angles which enlarge the slot widths as the slots extend through the screen 500 in a direction extending from the inside surface 526 to the outside surface 528. For example, FIG. 17 shows an alternative embodiment where a downstream slot-defining surface 524*a* is angled at a relief angle λ which causes the slot width to enlarge in size as the slot extends through the screen in a direction extending from the inside surface to the outside surface of the screen. Additionally, FIG. 18 shows a further embodiment where the upstream slot-defining surface 522*b* and downstream slot-defining surface 524*b* are oriented at relief angles λ that enlarge the size of the slot width as the slot extends through the screen 500 in a direction extending from the inside surface to the outside surface of the screen. In certain embodiments, the angles λ are at least 15 degrees or at least 30 degrees.

Figure 19:
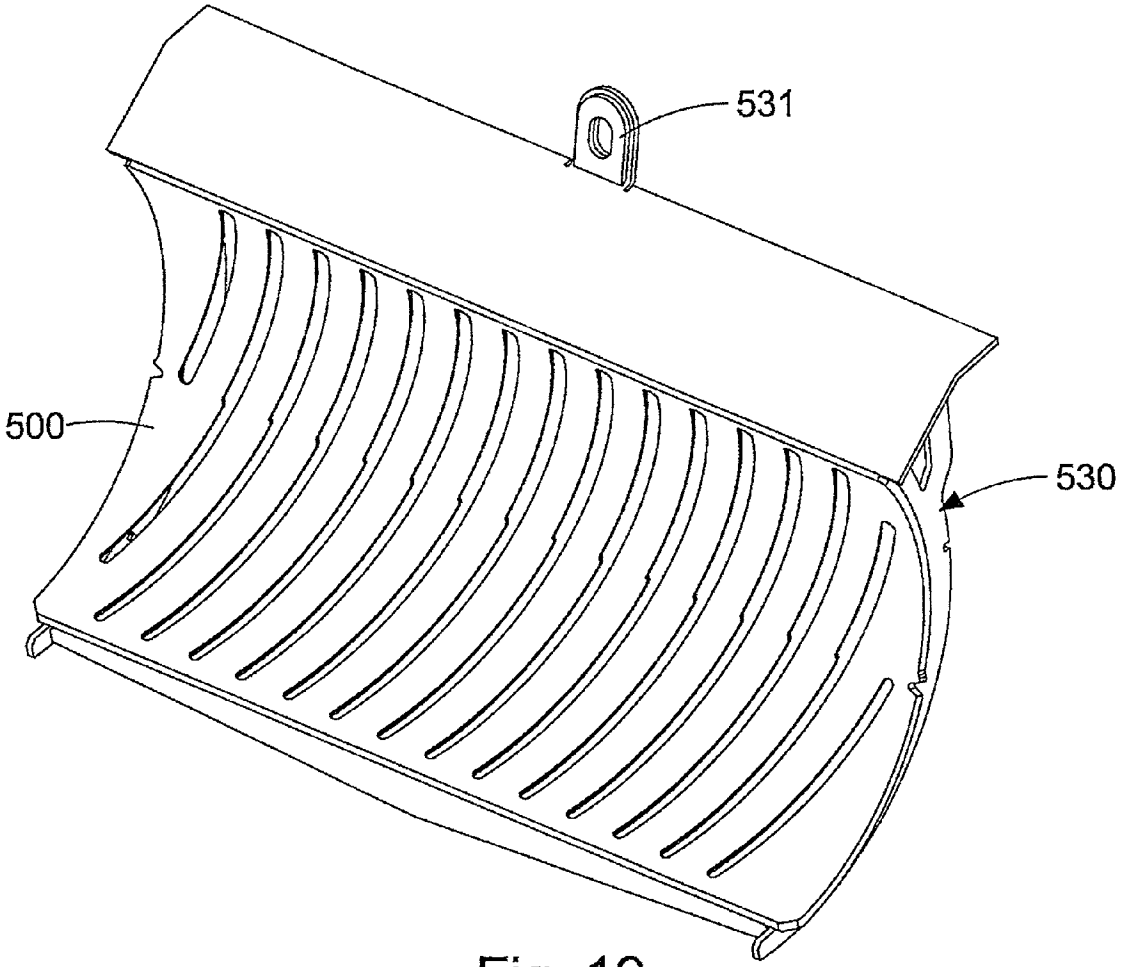
FIG. 19 is a perspective view of a sizing unit adapted to be removably mounted around a comminution chamber of the comminution machine of FIG. 1, the sizing unit includes the screen plate of FIG. 15.

FIG. 19 is a perspective view of the screen 500 shown mounted to a screen support structure 530 (i.e., a reinforcing framework) so as to form a sizing unit. The screen support structure 530 assists in making the screen 500 more rigid and also provides means for (e.g., a lifting eye 531) allowing the screen 500 to be easily lowered into and lifted out of a comminution apparatus with a structure such as a lift or crane.

Figure 20:
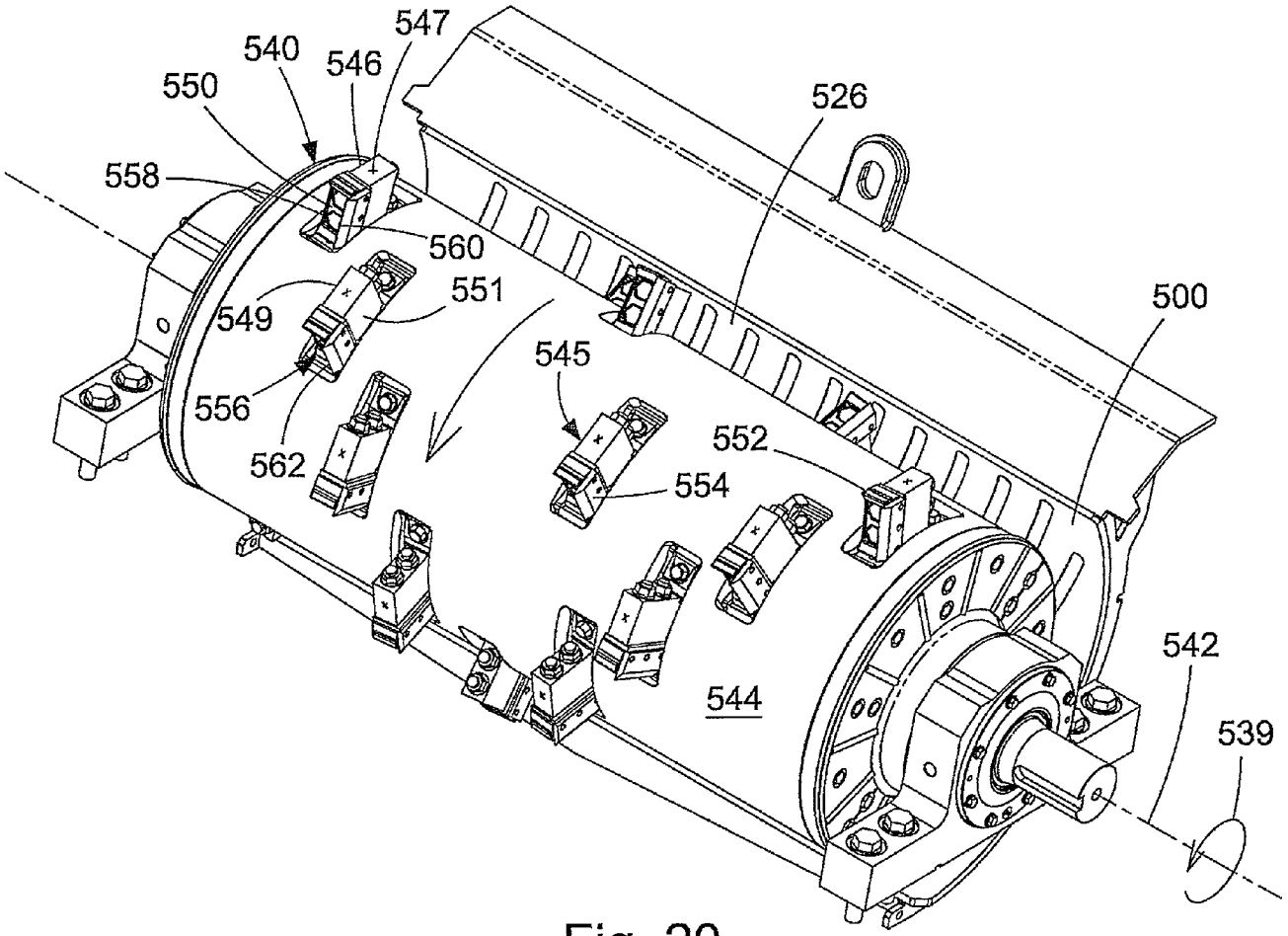
FIG. 20 is a perspective view showing the sizing unit of FIG. 19 partially surrounding a rotational reducing unit.

FIG. 20 depicts the screen 500 positioned to circumferentially surround a portion of a rotational reducing unit 540. During reducing operations, the rotational reducing unit 540 is rotated about a central axis of rotation 542. The rotational reducing unit 540 includes carrier in the form of a drum 544 carrying a plurality reducing components 545. The reducing components 545 include hammers 546 defining axes 547 that project primarily radially outwardly from an outer surface of the drum 544 and/or primarily radially outwardly from the axis of rotation 542. The hammers 546 have first sides 549 that face primarily toward the first side boundary 510, as defined on FIG. 15, of the screening region 502 and second sides 551 that face primarily toward the second side boundary 512 of the screening region 502. The hammers 547 also include leading faces 548 that extend between the sides 549, 551. The material reducing components 545 also include reducing blocks 550 having main faces 553 that cover/protect the leading faces 548 of the hammers 546. The main faces 553 face primarily in the reducing component travel direction 518 (i.e., in a downstream direction) when the reducing components 545 are moved along the inside surface 526 of the screen 500. Movement of the reducing components 545 along the inside surface the screen is caused by rotation of the rotational cutting unit 540 in direction 539 about axis 542 thereby causing the reducing components to sweep along the outer cutting diameter OCD. As the reducing components move along the outer cutting diameter OCD, the reducing components sweep across the screening region 502 in an upstream-to-downstream direction. The reducing blocks 550 also include reducing edges 552 that extend primarily along the axis of rotation 542 of the rotational reducing unit 540. The reducing edges 552 can also be described as extending primarily along the screen cross-dimension 514 and/or extending primarily along the slot widths SW. In the depicted embodiment, the edges 552 are blunt, but in alternative embodiments the edges could be sharp knife edges.

The material reducing components 545 further include lateral blades 554 (see FIGS. 22-24) positioned adjacent the second sides 551 of the hammers 547. The lateral blades 554 project outwardly from the main faces 553 of the reducing blocks 550 in the reducing component travel direction 518 and cooperate with the main faces 553 to form pockets 556 having open sides 558 at the first sides 549 of the hammers 546 and closed sides 560 at the second sides 551 of the hammers 546. The lateral blades 554 are oriented generally perpendicular relative to the main faces 553 of the reducing blocks 550. The lateral blades 554 include first sides 570 that face primarily toward the first side boundary 510 of the screening region 502 and that cooperate with the main faces 553 of the reducing blocks 550 to form the pockets 556. The main faces 553 of the reducing blocks 550 as well as the first sides 570 of the lateral blades 554 can also be referred to as pocket-defining surfaces. The lateral blades 554 include second sides 572 that face primarily toward the second side boundary 512 of the screening region 502. Forward portions of the second sides 572 of the lateral blades 554 are beveled to form leading blade edge 562 of the lateral blades 554. The edges 562 are preferably sharp knife edges, but could also be blunt or squared edges. The lateral blades 554 are preferably mounted at the sides 551 of the hammers 546 that are closest to the second side boundary 512 of the screening region 502. In this way, the first surfaces 570 of the side blades 554 can be positioned to oppose the downstream slot-defining surfaces 524 of the slots 516.

The leading blade edges 562 of the lateral blades 554 are shown extending primarily along the axes 547 of the hammers 546. The leading blade edges 562 can also be described as extending primarily radially outwardly from the inner surface 526 of the screen 500 and/or as extending primarily radially relative to the drum and/or the axis of rotation 542 of the rotational reducing unit. The leading blade edges 562 are positioned forwardly with respect to the reducing edges 552 of the reducing blocks 550. In other words, the leading blade edges 562 lead the reducing edges 552 when the reducing components 550 are moved along the inside surface 526 of the screen 500 during reducing operations. 28. In certain embodiments, the leading blade edges 562 of the lateral blades 554 are sharper than the reducing edges 552 of the reducing blocks 550.

Figure 21:
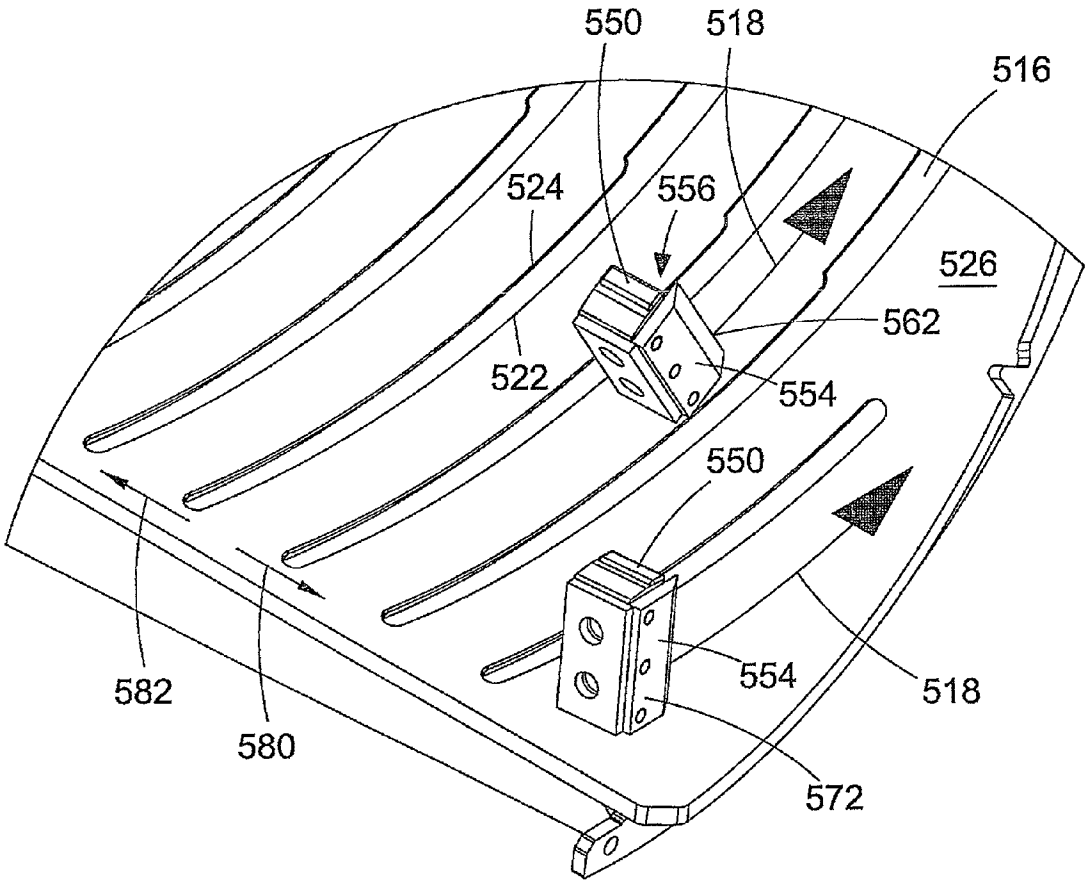
FIG. 21 shows the arrangement of FIG. 20 with portions of the rotational reducing unit removed so as to better illustrate the travel direction, positioning and orientation of material reducing components of the rotational reducing unit relative to the screen of the sizing unit.

As shown at FIG. 21, the oblique angling of the sizing slots 516 relative to the reducing component travel direction 518 causes the slots 516 to extend in a first lateral direction 580 as the slots 516 traverse the upstream-to-downstream dimension 508 in downstream direction. The first surfaces 570, as identified in FIG. 23, of the lateral blades 554 face primarily in a second lateral direction 582 that is opposite the first lateral direction 580. The first surfaces 570 also oppose the downstream slot-defining surfaces 524 of the sizing slots 516. Similarly, the main faces 553, identified in FIG. 22, of the reducing blocks 550 face at least partially toward and oppose the downstream slot-defining surfaces 524 of the sizing slots 516. The first surfaces 570 cooperate with the main faces 553 of the reducing blocks 550 to form the pockets 556. The open sides 558 of the pockets 556 face in the second lateral direction 582. This pocket configuration assists in encouraging material being reduced to be forced against the downstream slot-defining surfaces 524 of the sizing slots 516. For example, the configuration of the pockets inhibits material from flowing off of the main faces 553 of the reducing blocks 550 in the first lateral directions 580 and allows material to flow off of the main faces 553 of the reducing blocks 550 in the second lateral directions 582. This causes the material to be encouraged in the second lateral direction 582 and forced against the downstream slot-defining surfaces 524. It will be appreciated that the second lateral direction 582 opposes the downstream slot-defining surfaces 524.

It will be appreciated that incorporating lateral blades 554 as part of the reducing components of the rotational reducing unit eliminates the need for using fixed blades positioned upstream from the screen 500. However, in alternative embodiments, the material reducing components 545 can be used with comminution apparatuses having fixed blades positioned upstream from sizing screens. In such embodiments, the material reducing components 545 would pass between the fixed blades.

During material reduction, the reducing edges 552 of the reducing components 545 are swept circumferentially along the inner surface 526 of the screen 500 with a gap/clearance between the reducing components 545 and the inner surface 526 of the screen. In certain embodiments, the gap is at least 0.25 inches. In other embodiments, the gap g is in the range of 0.25-0.5 inches. In the depicted embodiment, no portions of the reducing components pass through or otherwise enter the sizing slots 516. In other words, the material reducing components 545 have an outmost travel boundary/path (the outer cutting diameter OCD) that is inwardly offset from the inner circumferential surface 526 of the screen 500 such that no portions of the material reducing components enter the sizing slots during material reduction. In the depicted embodiment, the material reducing components 545 have reducing component widths which extend primarily along the slot widths and are larger than the slot widths.

Figure 22:
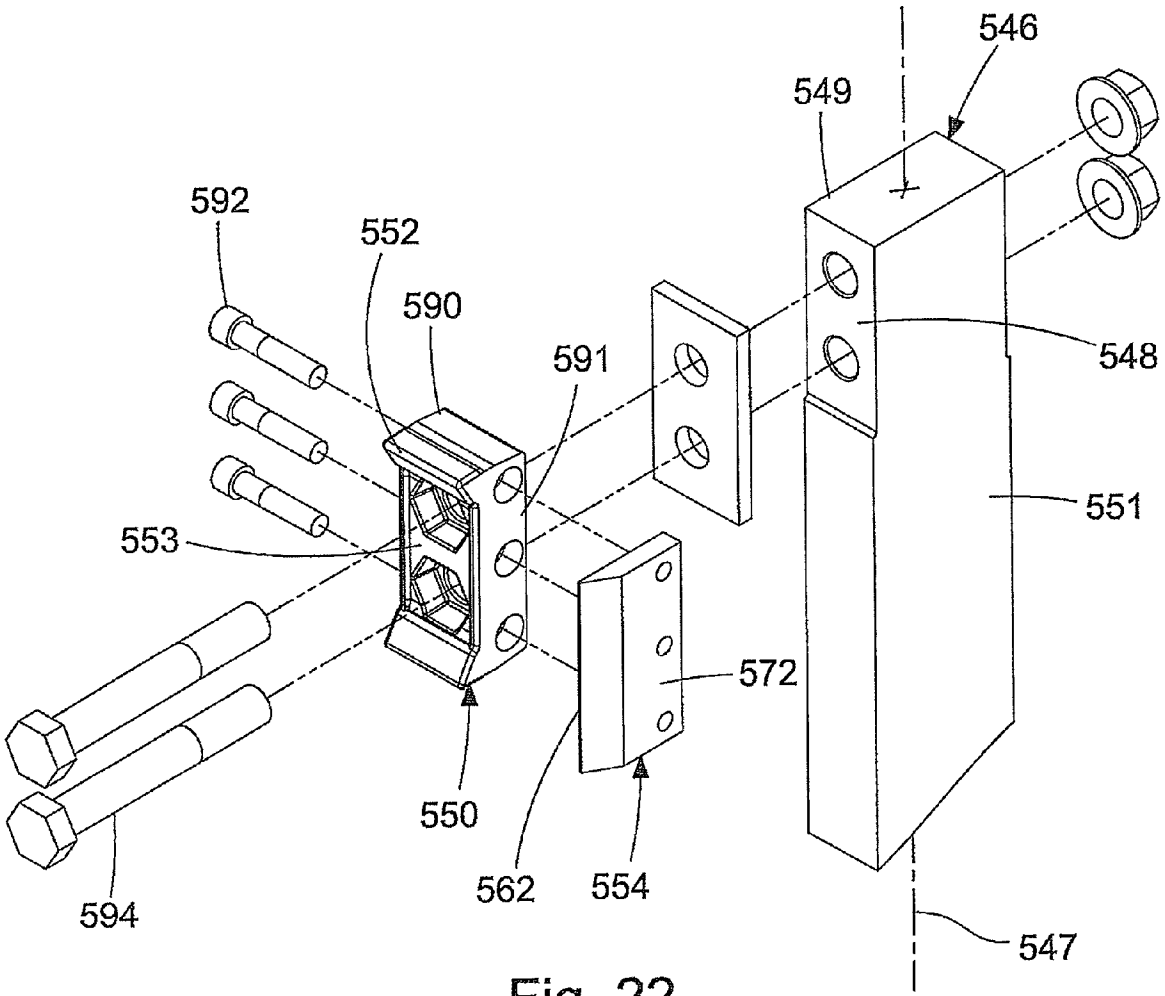
FIG. 22 is an exploded view of one of the material reducing components of the rotational reducing unit shown at FIG. 20.
Figure 23:
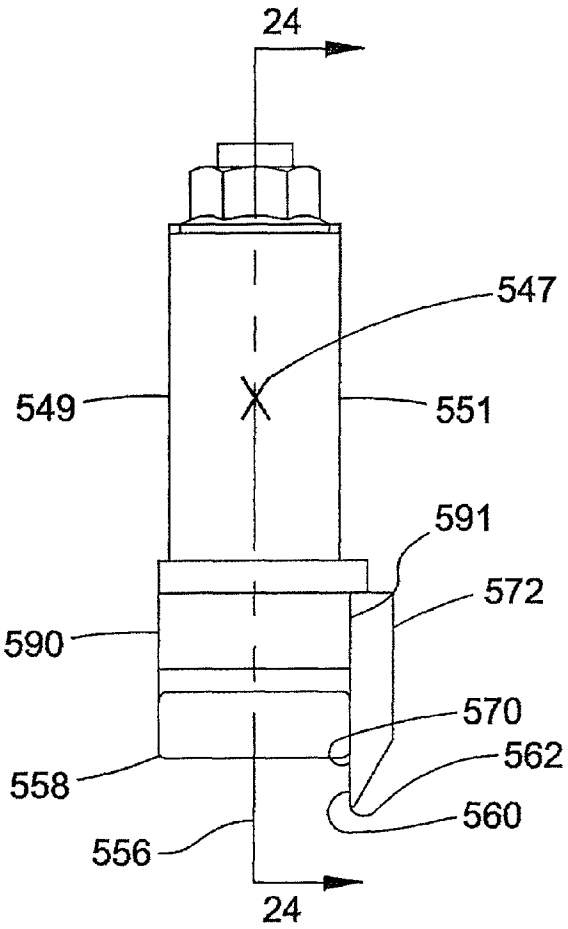
FIG. 23 is a top view of the assembled material reducing component of FIG. 22.
Figure 24:
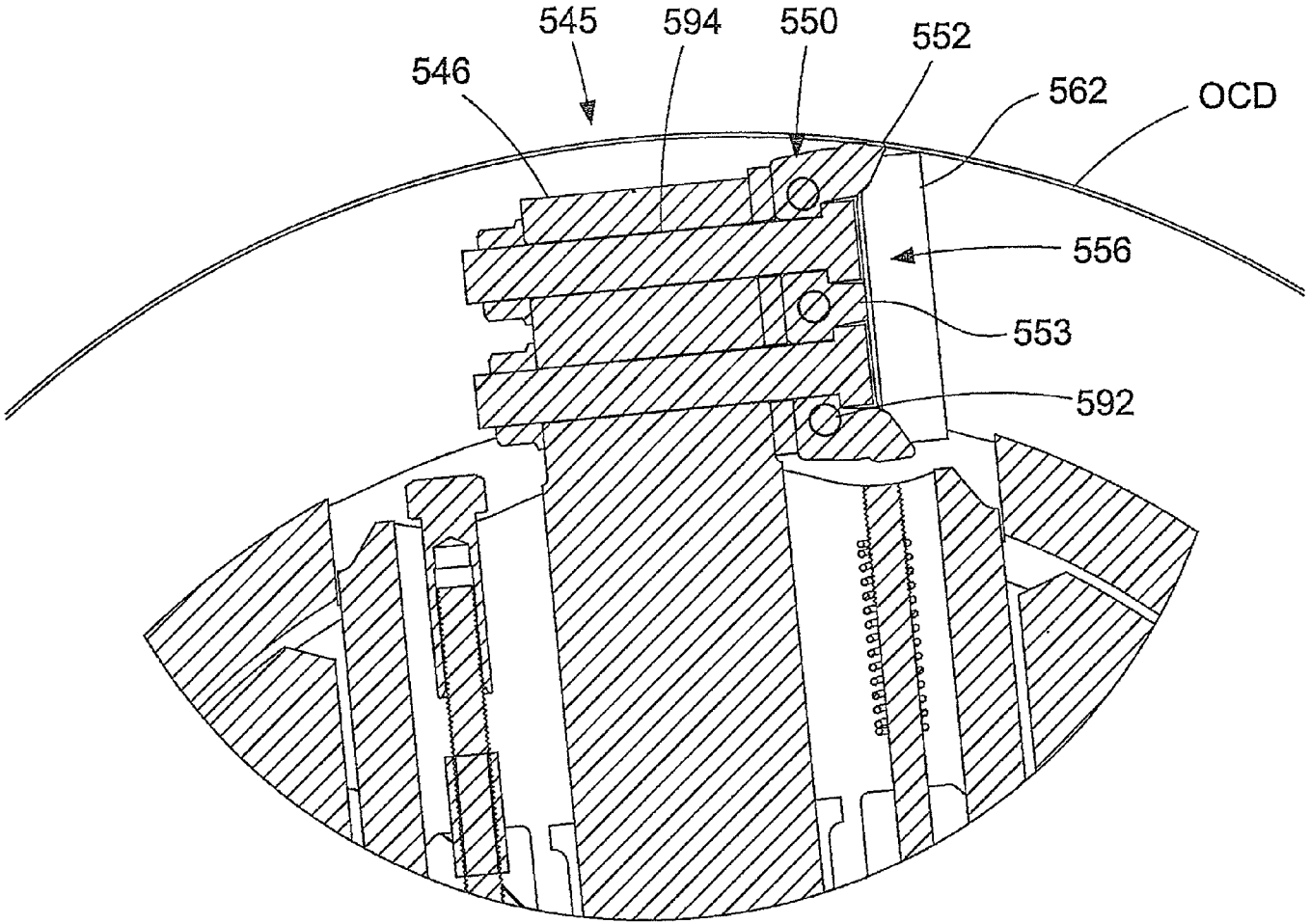
FIG. 24 is a cross-sectional view taken along section line 24-24 of FIG. 23.
Figure 25:
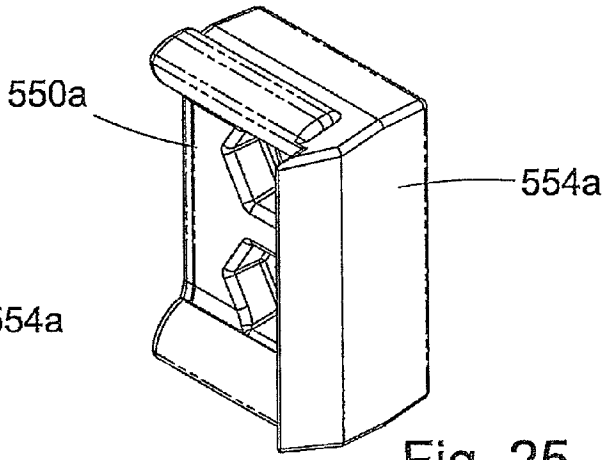
FIG. 25 is a perspective view of an alternative block and cutter arrangement that can be used in combination with the rotational reducing unit of FIG. 20.
Figure 26:
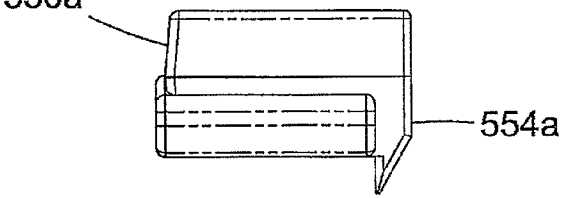
FIG. 26 is a top view of the block and cutter arrangement of FIG. 25.
Figure 28:
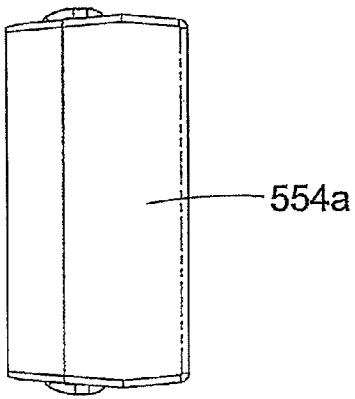
FIG. 28 is a side view of the block and cutter arrangement of FIG. 25.
Figure 27:
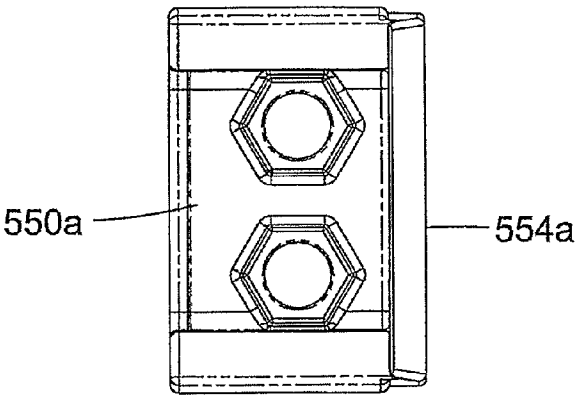
FIG. 27 is a front view of the block and cutter arrangement of FIG. 25.

Referring to FIGS. 22-24, the main faces 553 of the reducing blocks 550 extend between opposite first and second sides 590, 591 of the reducing blocks 550. The lateral blades 554 are mounted to the second sides 591 of the reducing block 550 by fasteners 592 that extend transversely through the reducing block 550 between the sides 590, 591. The reducing blocks 550 are secured to the hammers 546 by fasteners 594 that extend transversely through the main faces 553 of the reducing blocks 550 and also through the hammers 546.

FIG. 25-28 show an alternative reducing block configuration where lateral blade 554*a* has been integrally formed/cast with a corresponding reducing block 550*a*. The reducing block 550*a* can be mounted to a hammer in the same way previously described with respect to the reducing block 550.

As used herein, the phrase "primarily along" a reference axis, dimension or structure means for the most part along (i.e., with 45 degrees of) the reference axis, dimension or structure. Also, the phrase "extending primarily radially" with respect to a reference axis, dimension or structure means extending for the most part in a radial direction from or toward from the reference axis, dimension or structure. As described above, material being reduced moves across the sizing screen in an upstream to downstream direction. Thus, the upstream end of the sizing screen is adjacent the in-feed system where the material first contacts the screen and the downstream end of the sizing screen is where the material last contacts the sizing screen.

From the foregoing detailed description, it will be evident that modifications and variations can be made in the apparatus of the disclosure without departing from the spirit and scope of the disclosure.

What is claimed is:

1. A screening component for a comminution apparatus comprising:

a screen for at least partially surrounding a rotational reducing unit of the comminution apparatus, the screen including a screening region having an upstream-most boundary separated by a downstream-most boundary by an upstream-to-downstream screen dimension, the screening region including a plurality of first sizing slots having continuously open slot lengths and slot widths, the continuously open slot widths of the first sizing slots include first widths adjacent to the upstream-most boundary and second widths adjacent the downstream-most boundary, the first widths being smaller than the second widths, the continuously open slot lengths being longer than the slot widths, the continuously open slot lengths of the first sizing slots extending between the upstream-most boundary and the downstream-most boundary, the continuously open slot lengths traversing more than 50 percent of the upstream-to-downstream screen dimension.

2. The screening component of claim 1, further comprising second sizing slots having continuously open slot lengths that traverse less than 50 percent of the upstream-to-downstream screen dimension.

3. The screening component of claim 1, wherein the continuously open slot lengths traverse at least 75 percent of the upstream-to-downstream screen dimension.

4. The screening component of claim 1, wherein the continuously open slot lengths traverse at least 90 percent of the upstream-to-downstream screen dimension.

5. The screening component of claim 1, wherein the continuously open slot lengths traverse the entire upstream-to-downstream screen dimension.

6. The screening component of claim 5, further comprising second sizing slots having continuously open slot lengths that traverse less than 50 percent of the upstream-to-downstream screen dimension and third sizing slots having continuously open slot lengths that traverse 50 to 90 percent of the upstream-to-downstream screen dimension.

7. The screening component of claim 1, wherein the first sizing slots have serrated edges.

8. The screening component of claim 1, wherein the first sizing slots have upstream slot-defining surfaces and downstream slot-defining surfaces, and wherein at least the downstream slot-defining surfaces are angled at a relief angle that increases the slot width as the slot extends through the screen in an inside-to-outside direction.

9. The screening component of claim 1, wherein the first sizing slots have a length-to-width ratio of at least 10-to-1.

10. The screening component of claim 1, wherein the first sizing slots have a length-to-width ratio of at least 20-to-1.

11. The screening component of claim 1, wherein the first sizing slots have a length-to-width ratio of at least 30-to-1.

12. The screening component of claim 1, wherein the first sizing slots are separated by lands, wherein the lands have land lengths that extend along the slot lengths and land widths that extend between the first sizing slots, and wherein the land lengths are equal to the slot lengths and land widths are at least 1.5 inches.

13. The screening component of claim 1, wherein the first sizing slots are separated by lands having land lengths that extend along the slot lengths and land widths that extend between the first sizing slots, wherein the land widths are in the range of 1.5 to 3.0 inches and the slot widths are in the range of 0.75 to 2.0 inches.

14. The screening component of claim 1, wherein the first sizing slots have longitudinal slot defining surfaces, and wherein at least one longitudinal slot defining slot-defining surface is angled at a relief angle that increases the slot width as the slot extends through the screen in an inside-to-outside direction.

15. The screening component of claim 1, wherein the screening region also includes a plurality of second sizing slots having a different configuration than the first sizing slots.

16. A comminution apparatus comprising:

a rotational reducing unit that is rotatable about an axis of rotation, the rotational reducing unit including a plurality of first material reducing components mounted to a carrier, the first material reducing components being rotated by the carrier in a first reducing component travel direction about the axis of rotation; and a screen at least partially surrounding the rotational reducing unit, the screen defining a plurality of first sizing slots having slot lengths and slot widths, the first sizing slots being elongated along the slot lengths such that the slot lengths are longer than the slot widths, the slot lengths being continuously open, the slot lengths being oriented at oblique angles relative to the first reducing component travel direction, and the oblique angles being less than 45 degrees, and wherein the first sizing slots define a screening region having a upstream-to-downstream screen dimension that is parallel to the direction of travel of the material reducing components and a cross-screen dimension that is transversely oriented relative to the upstream-to-downstream dimension, wherein the first sizing slots are spaced-apart from one another along the cross-screen dimension, wherein the oblique angles of the first sizing slots cause the first sizing slots to angle in a first lateral direction across the cross-screen dimension as the slot lengths of the first sizing slots traverse the upstream-to-downstream dimension in a downstream direction, and wherein the first material reducing components are configured to encourage material flow in a second lateral direction that is opposite from the first lateral direction.

17. The comminution apparatus of claim 16, wherein the oblique angles are in the range of 5-30 degrees.

18. The comminution apparatus of claim 16, wherein the oblique angles are in the range of 10-25 degrees.

19. The comminution apparatus of claim 16, wherein the first sizing slots have longitudinal slot-defining surfaces, and wherein at least one longitudinal slot-defining surface is angled at a relief angle that increases the slot width as the slot extends through the screen in an inside-to-outside direction.

20. The comminution apparatus of claim 16, wherein the first sizing slots have a length-to-width ratio of at least 10-to-1.

21. The comminution apparatus of claim 16, wherein the first sizing slots have a length-to-width ratio of at least 20-to-1.

22. The comminution apparatus of claim 16, wherein the first sizing slots have a length-to-width ratio of at least 30-to-1.

23. The comminution apparatus of claim 16, wherein the first sizing slots are separated by lands having land lengths that extend along the slot lengths and land widths that extend between the first sizing slots, the land lengths being equal to the slot lengths and land widths being at least 1.5 inches.

24. The comminution apparatus of claim 16, wherein the first material reducing components include hammers having first and second opposite sides and leading faces extending between the opposite sides, wherein the hammers define axes that extend outwardly from the axis of rotation of the rotational reducing unit between the first and second sides of the hammers, wherein the first material reducing components include reducing blocks having main faces covering the leading faces of the hammers, wherein the reducing blocks include reducing edges that extend primarily along the axis of rotation of the rotational reducing unit, wherein the main faces of the reducing blocks face primarily in the first reducing component travel direction, wherein the first material reducing components also including lateral blades positioned adjacent the second sides of the hammers, wherein the lateral blades project outwardly from the main faces in the first reducing component travel direction and cooperate with the main faces to form pockets having open sides at the first sides of the hammers and closed sides at the second sides of the hammers, and wherein the lateral blades have leading blade edges that extend primarily along the axes of the hammers, and wherein the leading blade edges are positioned forwardly with respect to the reducing edges.

25. The comminution apparatus of claim 24, wherein the leading blade edges are sharper than the reducing edges of the reducing blocks.

26. The comminution apparatus of claim 24, wherein the lateral blades are oriented generally perpendicular relative to the main faces of the reducing blocks.

27. The comminution apparatus of claim 16, wherein the oblique angles of the first sizing slots cause the first sizing slots to angle in a first lateral direction as the slot lengths of the first sizing slots traverse the upstream-to-downstream dimension in a downstream direction, wherein the first material reducing components include first pocket-defining surfaces that face primarily in the direction of travel of the first reducing components, wherein the first material reducing components also including second pocket-defining surfaces that face primarily in a second lateral direction that is opposite from the first lateral direction, the first pocket-defining surfaces cooperating with the second pocket-defining surfaces to form pockets of the first material reducing components, wherein when material is reduced by the comminution apparatus, the second pocket-defining surfaces resist material flow around the first pocket-defining surfaces in the first lateral direction.

28. The comminution apparatus of claim 27, wherein the first material reducing components include reducing hammers, wherein the first pocket-defining surfaces are positioned in front of leading faces of hammers, and wherein the second pocket-defining surfaces are positioned adjacent sides of the hammers.

29. The comminution apparatus of claim 16, wherein the first material reducing components are configured to resist material flow around the first material reducing components in the first lateral direction.

30. The comminution apparatus of claim 16, wherein the first material reducing components include pockets having closed sides that resist material flow around the first material reducing components in the first lateral direction and open sides that allow material flow around the first material reducing components in a second lateral direction that is opposite from the first lateral direction.

31. The comminution apparatus of claim 16, wherein the first material reducing components each include a first reducing edge that extends primarily along the cross-screen dimension and a second reducing edge that extends primarily radially inwardly from an inner circumferential surface of the screen.

32. The comminution apparatus of claim 31, wherein the first material reducing components include reducing hammers, wherein the first reducing edges are defined by blocks having main faces protecting leading faces of the hammers, and wherein the second reducing edges are defined by side blades positioned adjacent to sides of the main faces.

33. The comminution apparatus of claim 32, wherein the side blades project outwardly from the main faces primarily in the direction of travel of the first material reducing components, and wherein the second reducing edges are positioned forwardly with respect to the first reducing edges.

34. The comminution apparatus of claim 16, wherein the cross-screen dimension extends between a first side boundary and a second side boundary of the screening region, wherein the oblique angles of the first sizing slots cause the first sizing slots to angle in a first lateral direction across the cross-screen dimension from the first side boundary toward the second side boundary as the slot lengths of the sizing slots traverse the upstream-to-downstream dimension in a downstream direction, wherein the first material reducing components include hammers having leading faces, wherein the leading faces extend between first and second sides of the hammers, wherein the first sides of the hammers face toward the first side boundary and the second sides of the hammers face toward the second side boundary, wherein the first material reducing components include reducing blocks having main faces that protect the leading faces of the hammers, wherein the reducing blocks include first reducing edges that extend primarily along the cross-screen dimension, wherein the first material reducing components also include side blades positioned adjacent the second sides of the hammers, wherein the side blades project forwardly from the main faces of the reducing blocks, and wherein the side blades include leading edges that extend primarily inwardly from a circumferential inner surface of the screen.

35. A comminution apparatus of claim 16, wherein the rotational reducing unit further includes a plurality of second material reducing components mounted to the carrier having a different configuration than the first material reducing components, the second material reducing components being rotated by the carrier in a second reducing component travel direction, wherein the screen further defines a plurality of second sizing slots having a different configuration than the first sizing slots, and wherein the first material reducing components correspond with the first sizing slots and the second material reducing components correspond with the second sizing slots.

36. A comminution apparatus comprising:

a rotational reducing unit that is rotatable about an axis of rotation, the rotational reducing unit including a plurality of material reducing components mounted to a carrier, the material reducing components being rotated by the carrier in a reducing component travel direction about the axis of rotation; and a screen at least partially surrounding the rotational reducing unit, the screen including a screening region having an upstream-most boundary separated by a downstream-most boundary by an upstream-to-downstream screen dimension that is parallel to the reducing component travel direction, the screening region including a plurality of sizing slots having continuously open slot lengths and slot widths, the continuously open slot lengths being longer than the slot widths, the continuously open slot lengths of at least some of the sizing slots extending completely from the upstream-most boundary to the downstream-most boundary of the screening region, and wherein the slot widths of the sizing slots include first widths adjacent to the upstream-most boundary and second widths adjacent the downstream-most boundary, the first widths being smaller than the second widths.

37. The comminution apparatus of claim 36, wherein the screen includes an inner circumferential surface, and wherein the material reducing components have an outermost travel boundary that is inwardly offset from the inner circumferential surface of the screen such that no portions of the material reducing components enter the sizing slots during material reduction.

38. The comminution apparatus of claim 36, wherein the material reducing components have reducing component widths which extend primarily along the slot widths, the reducing component widths being larger than the slot widths.

39. A comminution apparatus comprising:

a cylindrical drum configured to rotate in a direction of rotation comprising:

an axis of rotation; and blunt material reducing components fixed to the cylindrical drum, wherein each blunt material reducing component defines a volume of rotation with an outer diameter as the cylindrical drum is rotated, and wherein there is a space between the volume of rotation of at least some of the adjacent material reducing components;

an infeed system comprising a floor with a fixed anvil positioned adjacent the cylindrical drum;

fixed knives offset in a downstream relationship from the anvil, as defined by the direction of travel of the drum, extending from beyond the cutting diameter into an overlapping relationship with the blunt material reducing components with an end that extends into the space between the material reducing components; and a sizing screen positioned adjacent the fixed knives, with long narrow slots.

40. A comminution apparatus comprising:

a cylindrical drum configured to rotate in a direction of rotation including:

an axis of rotation; and blunt material reducing components fixed to the cylindrical drum, wherein the material reducing components are configured to be rotated by the drum in a reducing component travel direction about the axis of rotation; and a screen at least partially surrounding the cylindrical drum, the screen defining a plurality of first sizing slots extending at least partially in the reducing component travel direction, the first sizing slots having continuously open slot lengths and slot widths, the first sizing slots being elongated along the continuously open slot lengths such that the continuously open slot lengths are longer than the continuously open slot widths, the continuously open slot lengths being oriented at oblique angles relative to the reducing component travel direction and the continuously open slot widths increasing in size along the slot lengths in the reducing component travel direction, and wherein the first sizing slots have longitudinal slot defining surfaces, and wherein at least one longitudinal slot defining slot-defining surface is angled at a relief angle that increases the slot width as the slot extends through the screen in an inside-to-outside direction.

* * * * *